United States Patent [19]

Ploeger, Jr. et al.

[11] 4,115,012

[45] Sep. 19, 1978

[54] PRINTING RIBBON SPOOL

[76] Inventors: Walter Ploeger, Jr.; Jeanne M. Ploeger, both of North Bellmore, N.Y. 11710

[21] Appl. No.: 758,279

[22] Filed: Jan. 10, 1977

[51] Int. Cl.[2] ..... B41J 31/16

[52] U.S. Cl. ..... 400/202.1; 400/242

[58] Field of Search ..... 197/151, 171, 175; 118/260, 268; 427/429

[56] References Cited

U.S. PATENT DOCUMENTS

| | | | |
|---|---|---|---|
| 2,969,865 | 1/1961 | Long | 197/171 |
| 3,003,461 | 10/1961 | Rosenthal | 118/268 X |
| 3,097,597 | 7/1963 | Visser | 118/260 X |
| 3,460,665 | 8/1969 | Dodsworth et al. | 197/171 |
| 3,819,026 | 6/1974 | Ploeger, Jr. et al. | 197/171 |
| 3,943,540 | 3/1976 | Van der Heyden | 118/260 X |

*Primary Examiner*—Paul T. Sewell

*Attorney, Agent, or Firm*—Seidel, Gonda & Goldhammer

[57] ABSTRACT

A printing ribbon spool is disclosed for maintaining the print-out density or consistency of a printing ribbon by contact between a woven or knitted pad on the spool and a side edge of the ribbon. Ink is communicated to the pad from a sealed reservoir by way of a woven or knitted fabric which communicates with the reservoir through a hole substantially smaller in diameter than the transverse width of the wick in its normal condition.

8 Claims, 6 Drawing Figures

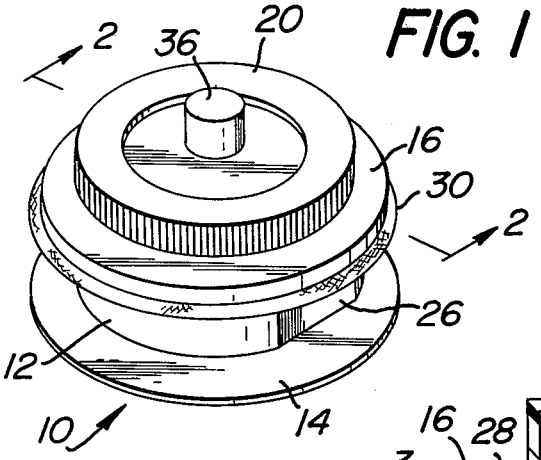
FIG. 1
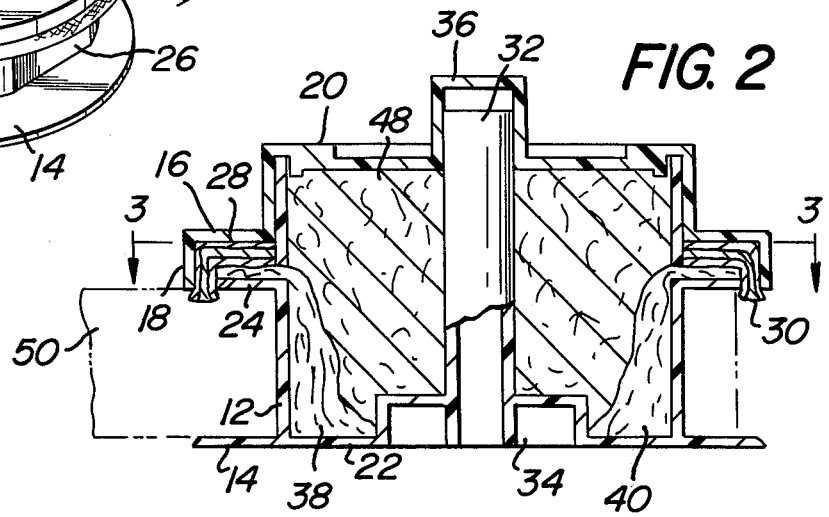
FIG. 2
FIG. 3
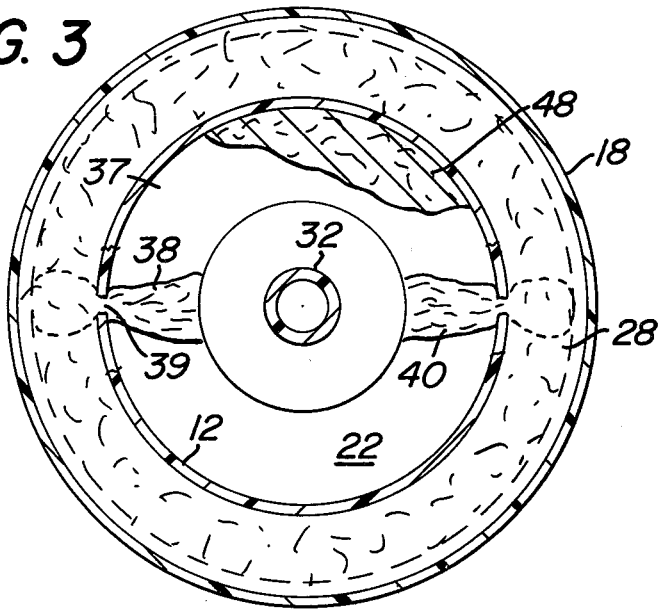
FIG. 5
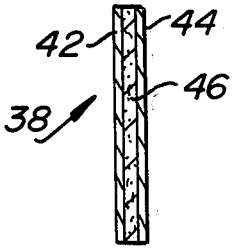
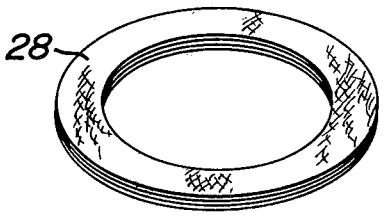
FIG. 4
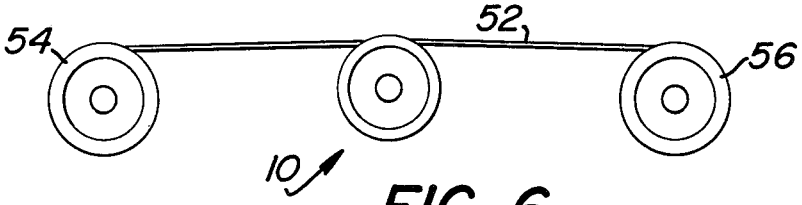
FIG. 6

PRINTING RIBBON SPOOL

BACKGROUND

This invention is an improvement over the invention of U.S. Pat. No. 3,819,026. See class 197/171.

The invention set forth in the above-mentioned patent has performed very well but has one drawback. The pad and wick disclosed in said patent are of felt. Felt is a highly absorbent fabric made of pressing natural fibers together as compared with fabrics made by weaving or knitting. Experience with the spool in said patent has indicated a lack of uniformity in the nature of felt from one batch to another which results in uneveness or lack of uniformity of ink capacity and print-out density. The present invention includes recognition of the problem area and a solution to the problem by providing materials for the wick and pad which exclude felt whereby the above problem and other problems are solved.

SUMMARY OF THE INVENTION

The present invention is directed to a printing ribbon spool which may be a ribbon wound thereon or which may be used as an idler for contact with ribbon coupled at its ends to a pair of spools. The invention comprises an annular spool body having a hub and a pair of radially outwardly directed flanges spaced from one another by a distance so as to accommodate a printing ribbon therebetween. An annular deformable pad of woven or knitted fabric is supported at one of said flanges in a position so that an exposed edge of the pad will have contact with a side edge of at least a portion of a ribbon disposed between the flanges.

A reservoir is supported by the body. A wick extends between said pad and reservoir for transferring ink from the reservoir to the pad by capillary action. Said wick includes at least one layer of woven or knitted fabric. A means defines at least one access opening to the reservoir through which the fabric wick extends. The access opening is smaller in transverse dimensions that the width of the fabric wick so that the fabric wick is deformed at said access opening. Ink is transferred from the reservoir to the pad as a result of flexing of the exposed portion of the pad by contact with a side edge of the ribbon.

It is an object of the present invention to provide a printing ribbon spool which uses materials for a pad and wick which eliminate problems of uniformity in ink capacity and print-out density.

It is another object of the present invention to provide a printing ribbon spool having a number of controllable variables with respect to the rate of ink transfer.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a spool in accordance with the present invention.

FIG. 2 is a sectional view taken along the line 2—2 in FIG. 1.

FIG. 3 is a sectional view taken along the line 3—3 in FIG. 2.

FIG. 4 is a perspective view of a pad.

FIG. 5 is a sectional view through the preferred embodiment of the wick.

FIG. 6 is a top plan view showing the spool of the present invention as an idler spool for re-inking a ribbon on a pair of spools.

Referring to the drawing in detail, wherein like numerals indicate like elements, there is shown in FIG. 1 a printing ribbon spool in accordance with the present invention designated generally as 10.

The spool 10 has a body which includes a circular hub 12 having a radially outwardly directed flange 14 at its lower end and a radially outwardly directed flange 16 adjacent its upper end. The flanges 14 and 16 are spaced from one another and are parallel to one another. Flange 16 has a downwardly extending end portion 18 projecting toward the flange 14. Flanges 14 and 16 are of the same diameter. Flange 14 is integral with the side wall 22 of the body while flange 16 is integral with the stepped side wall 20 of the body. Hub 12 extends between the side walls 20, 22.

The hub 12 is preferably provided with one or more flats 26 when being utilized on a Teletype printer. When more than one flat is provided, the flats 26 are opposite one another. One of the flats serves to provide an acceptable surface for attachment, in any convenient manner such as by ultrasonic welding, to one end of an inked ribbon 50. The other flat is utilized to provide take-up space for the metal reversing eyelet which effects reversing of the ribbon 50 on the Teletype printer. The terminal end portion of the ribbon constituting a length at least equal to the circumference of the hub 12 is either of reduced width or rendered ink impregnable such as by use of an ink impervious plastic shield so as to prevent ink from accumulating in the terminal end portion.

The hub 12 has a third flange 24 which extends radially outwardly. The length of flange 24 in a radial direction is substantially less than the radial length of flanges 14 and 16. As shown more clearly in FIG. 2, flange 24 is closer to flange 16. The radial length of flange 24 exceeds the radial thickness of ribbon 50 which will accumulate on hub 12 of a fully wound spool 10.

An annular pad 28 is provided in the zone between flanges 16 and 24. Pad 28 is made from a material which is preferably slightly absorbent and of sufficient diameter so that the outer peripheral portion may extend downwardly through the annular gap defined by the outer periphery of flange 24 and the inner periphery of end portion 18. See FIG. 1.

The pad 28 is made from a flexible material which easily deforms so that its outer peripheral portion 30 may extend through said gap merely by the assembly of side wall 20 to the hub 12. In this regard, a felt pad as disclosed in said patent required the pad to be preformed so as to have a generally cup-shape. Pad 28 readily adopts the cup-shape without any preforming. A preferred material for pad 28 is a material known in the garment trade as "bonded double knit." Bonded double knit material has been used for wearing apparel and is typically a 100% polyester double knit with a foam and 100% acetate backing. Thus, the bonded double knit material has a layer of foam plastic sandwiched between and bonded to a layer of double knit material such as polyester and a layer of knitted fabric such as acetate. The layer of foam is not necessary but is preferred since it acts as a stiffener and gives body to the pad 28. When pad 28 is made from said bonded double knit material, it is slightly absorbent so that is does not have excess ink therein during any shut down time but rather merely acts as a transfer agent. While felt is a hydrophilic material, woven or knitted polyester, nylon, acetate, etc. are hydrophobic materials.

The body of spool 10 includes a core 32 integral with the side wall 22 at the center of the spool. Core 32 is concentric with the hub 12 and has a hollow interior open at its lower end. See FIG. 2. Immediately surrounding the lower end of core 32, the bottom wall 22 is provided with a recess 34. Recess 34 is annular and adapted to receive a driver such as driver 28 in the above-mentioned patent. Core 32 at its upper end is telescoped into a socket 36 integral with the side wall 20. The cooperation between core 32 and sprocket 36 assures that the top wall 20 is properly orientated with respect to the hub 12 and bottom wall 22.

The body of spool 10 is preferably made in two pieces from ink impervious lightweight material such as a polymeric plastic. A suitable polymeric plastic would be Celcon which is a commercially available high crystalin acetal copolymer based on trioxane. The upper edge portion of hub 12 and the adjacent annular recess on wall 20 receiving the hub 12 are hermetically sealed in any convenient manner such as by use of ultrasonic welding, adhesives, and the like. If desired, the core 32 and socket 36 may be similarly hermetically sealed.

Thus, the body of spool 10 is provided with an annular sealed chamber 37 adapted to contain an ink reservoir. Within the chamber 37, there is provided wicks 38 and 40. The wicks 38 and 40 are identical. One or more such wicks may be provided. Hence, only wick 38 will be described in detail.

The wick 38 in the preferred embodiment includes strips of woven or knitted fabric 42 and 44 with a layer 46 of ink impervious polymeric plastic such as nylon disposed therebetween. Fabric 42, 44 may be nylon, cotton, silk, etc., which has been woven or knitted and has good ink transferring properties. Referring to FIG. 5, the side edges of each of the layers 42, 44 of fabric are welded only to the adjacent side edges of the layer 46 to thereby form a laminate for transferring ink from the reservoir to the pad 28 by capillary action.

Suitable dimensions for the wick 38 are as follows. The layers 42 and 44 of nylon fabric have a thickness of 0.005 inches and a width of 7/16 inches. The layer 46 of nylon film has a thickness between 0.0015 and 0.003 inches and a width of 7/16 inches. The layer 46 enhances the capillary action and acts as a stiffner. While layer 46 of ink impervious film is preferred, it is not essential. Pad 28 has a thickness of about 0.62 inches, an ID of about 1.375 inches, and an OD of about 2¼ inches.

One end of the wick 38 is disposed within the chamber 37. The other end portion of wick 38 extends through a restricted opening 39 in the hub 12. See FIG. 3. The transverse dimensions of opening 39, which is preferably a circular hole, is substantially less than the preferred width of wick 38 whereby the wick 38 must be deformed so that it may extend through the opening 39. Opening 39 may have a diameter between about 0.040 inches and 0.200 inches for the above wicks. Thus, the diameter of hole 39 is substantially smaller than the width of the wick which preferably has a width of 7/16 inches. If the wick is a thread, a larger number are needed and opening 39 may have a diameter of about 0.005 inches. The opening 39 is immediately adjacent the upper surface of flange 24 so that the outer peripheral end portion of wick 38 projecting through the opening 39 is supported by flange 24 with one of the layers of fabric 42, 44 in contact with the pad 28. Since wick 38 and pad 28 are layers of woven or knitted fabric, the zone of contact therebetween is substantially greater than in prior spools. Except for the opening 39, chamber 37 is hermetically sealed.

The present invention provides for three variables for controlling the rate of feed ink by the wick 38 to the pad 28. A first variable is the diameter of the opening 39 wherein ink flow increases with the size of the opening. A second variable is the width of the layers of fabric 42, 44 and the third variable is the thickness of the layer 46 of ink impervious film. Increasing the width of the wick 38 and increasing the thickness of layer 46 of plastic film with the diameter of hole 39 constant, each independently decrease the capillary action. The ink reservoir may include a carrier 48 of an absorbent deformable material such as felt impregnated with ink and occupying the entirety of chamber 37 in intimate contact with the wick 38. We prefer to avoid use of such carrier 48 and instead pour ink at an elevated temperature into the chamber 37.

Spool 10 may be utilized in conjunction with another identical spool with the ribbon 50 wound therearound and extending therebetween. Also, spool 10 may be used by itself for re-inking a ribbon 52. As shown in FIG. 6, ribbon 52 is wound on and extends between the spool 54, 56. Spool 10 acts as an idler for contact with the ribbon 52 in a manner whereby ribbon 52 passes between the flanges 14 and 24 with the edge portion 30 of the pad 28 in contact with a side edge portion of the ribbon 52.

In view of the disclosure in the above-mentioned patent, a detailed description of operation is not deemed necessary. The contact between a side edge portion of the ribbon 50 or ribbon 52 causes a wiggling action on the exposed portion 30 of the pad 28 which acts as a pump for causing the ink to flow by capillary action from the reservoir along the wick 38 to the pad 28 and from the exposed portion 30 to the ribbon 50 or 52 in contact therewith. As ink is withdrawn from the printing ribbons, such as by contact with a key, the struck area will replenish itself by drawing ink through capillary action as described above. Since pad 28, when made from the materials such as those described above is generally adsorbent, during inactivity the ink will return by capillary action to the reservoir.

Thus, it will be seen that I have solved the problem of non-uniformity print density by providing a wick and pad of woven or knitted materials whereby uniformity from spool to spool may be more accurately controlled while having other advantages as disclosed herein. A woven fabric includes fabrics made by braiding and/or weaving.

The present invention may be embodied in other specific forms without departing from the spirit or essential attributes thereof and, accordingly, reference should be made to the appended claims, rather than to the foregoing specification as indicating the scope of the invention.

I claim:

1. A spool for replenishing ink in a printing ribbon comprising an annular spool body having a hub and a pair of spaced radially outwardly directed flanges, said flanges being spaced apart so as to accommodate a ribbon therebetween, an annular pad of deformable material selected from the group consisting of woven and knitted material supported by said body in a position so that an outer peripheral edge portion of the pad can have contact with the side edge of at least a portion of the ribbon disposed between the flanges, a reservoir supported by said body, a wick of deformable material including at least one layer of fabric selected from the group consisting of woven fabric and knitted fabric, said wick extending between the reservoir and pad for transferring ink from the reservoir to the pad by capillary action, said wick including two layers of nylon fabric bonded only at their side edges to a layer of ink impervious polymeric plastic film disposed between the layers of the fabric, means defining at least one access opening to the reservoir and through which said wick extends, said opening being substantially smaller in transverse dimensions than the transverse dimensions of the wick, and said body including means to provide a hermetic seal for said reservoir.

2. A spool in accordance with claim 1 wherein said pad is a laminate of a layer of fabric knitted of polymeric plastic fibers and bonded to a layer of polymeric plastic foam.

3. A spool in accordance with claim 2 wherein said pad foam layer is sandwiched between first and second layers of fabric made from a polymeric plastic material.

4. A spool for replenishing ink in a printing ribbon comprising an annular body containing an ink reservoir which is surrounded by a hub, said hub having a pair of parallel radially outwardly directed flanges spaced apart for a sufficient distance so as to accommodate a printing ribbon therebetween, a pad supported by said body adjacent one of said flanges with an exposed portion for transferring ink to a side edge portion of a ribbon portion disposed between said flanges, a wick having one end communicating with said reservoir and its other end communicating with said pad for transferring ink to the pad, an intermediate portion of said wick being constricted, said wick including a layer as woven or knitted fabric whose width is substantially greater than its thickness and bonded only at its side edge portions to a layer of ink impervious plastic, said pad being at least in part a layer of woven or knitted fabric made from a polymeric plastic material with the inner peripheral portion of the pad overlying the outer peripheral portion of said wick.

5. A spool in accordance with claim 4 wherein said pad fabric is bonded to a juxtaposed layer of polymeric plastic foam.

6. A spool in accordance with claim 4 wherein said body includes a side wall having an annular recess into which one end of said hub extends and is hermetically sealed thereto.

7. A spool for replenishing ink in a printing ribbon comprising an annular plastic body containing an ink reservoir surrounded by a hub adapted to have a printing ribbon juxtaposed thereto, a pad supported by said body adjacent one end of said hub with an exposed portion for transferring ink to a side edge portion of a ribbon juxtaposed to the hub, a wick having a first end portion communicating with said reservoir and a second end portion contacting said pad for transferring ink to said pad, the wick being at least in part a strip of fabric selected from the group consisting of woven fabric and knitted fabric having a width at least 20 times as great as its thickness, said pad being at least in part a layer of fabric selected from the group consisting of woven fabric and knitted fabric, the inner portion of said pad being juxtaposed to said second end portion of said wick, said body having an opening adjacent said one end of the hub, said opening being substantially smaller than the transverse dimensions of the wick while being substantially greater than the thickness of said wick, and a portion of said wick intermediate said wick ends being constricted at and extending through said opening.

8. A spool in accordance with claim 7 wherein said pad fabric is bonded to a juxtaposed layer of polymeric plastic foam.

* * * * *